US007168129B2

(12) United States Patent
Smith

(10) Patent No.: US 7,168,129 B2
(45) Date of Patent: Jan. 30, 2007

(54) SURFACE CLEANING DEVICE

(76) Inventor: Lisa A. Smith, 9282 W. Texas Dr., Lakewood, CO (US) 80232

( * ) Notice: Subject to any disclaimer, the term of this patent is extended or adjusted under 35 U.S.C. 154(b) by 391 days.

(21) Appl. No.: 10/709,272

(22) Filed: Apr. 26, 2004

(65) Prior Publication Data

US 2005/0235456 A1 Oct. 27, 2005

(51) Int. Cl.
*A47L 9/02* (2006.01)

(52) U.S. Cl. ..... 15/416; 15/393

(58) Field of Classification Search ..... 15/393, 15/395, 398, 415.1, 416, 417; *A47I 9/02*
See application file for complete search history.

(56) References Cited

U.S. PATENT DOCUMENTS

| | | | | | |
|---|---|---|---|---|---|
| 1,740,001 | A | * | 12/1929 | Carlstedt | 15/416 |
| 2,432,670 | A | * | 12/1947 | Lampe | 15/417 |
| 5,377,375 | A | | 1/1995 | Holman et al. | 15/49.1 |
| 5,502,870 | A | | 4/1996 | Ragner et al. | 15/393 |
| 5,755,007 | A | | 5/1998 | Dyson | 15/327.5 |
| 5,839,161 | A | | 11/1998 | Liang | 15/398 |
| 5,937,477 | A | | 8/1999 | Dyson | 15/327.2 |
| 5,970,577 | A | * | 10/1999 | Kim | 15/416 |
| 6,029,310 | A | | 2/2000 | Besel | 15/322 |
| 6,038,732 | A | | 3/2000 | McKnight et al. | 15/414 |
| 6,401,296 | B1 | | 6/2002 | McKnight et al. | 15/414 |

FOREIGN PATENT DOCUMENTS

| | | | |
|---|---|---|---|
| GB | 2224195 A | | 5/1990 |
| GB | 2364499 | * | 1/2002 |

* cited by examiner

*Primary Examiner*—Theresa T. Snider
(74) *Attorney, Agent, or Firm*—Roger A. Jackson

(57) ABSTRACT

A surface cleaning device used with a vacuum cleaner nozzle inlet to clean a selected surface profile, includes a housing with a surrounding sidewall defining a housing interior. A divider is disposed within the housing interior, to separate into a first and second housing interior. The surrounding sidewall terminates in a first opening communicating between the first housing interior and an exterior environment and a second opening communicating between the second housing interior and the exterior environment. The first and second openings are approximately matched in profile to respective selected surface profiles to clean. A divider aperture collar is adjacent to the divider forming a fluid communication between the first and second housing interiors. The divider aperture collar is removably engagable to the nozzle to create a substantially fluid tight communication selectively between either the first housing interior and the nozzle or the second housing interior and the nozzle.

16 Claims, 5 Drawing Sheets

SURFACE CLEANING DEVICE

TECHNICAL FIELD

The present invention generally relates to vacuum cleaner accessories and more particularly to hand held vacuum nozzles commonly used for surface, carpet, and upholstery cleaning on a selected profile surface.

BACKGROUND OF INVENTION

Typically, carpeted or uncarpeted stairs and furniture upholstery have been vacuumed and/or cleaned by a combination of vacuum and solution cleaning processes using a relatively small hand-held suction nozzle of approximately 6 inches in width. The nozzle is typically connected by a flexible hose to a vacuum source such as a vacuum cleaner or a steam/solution cleaner. However, when vacuum cleaning or utilizing the steam/solution cleaning process in combination with a vacuum it is typically difficult to adequately clean a specific or selected profile surface such as a sharply curved convex/concave surface, for example the toe or corner of a step or an upholstery arm due to the typically long straight suction inlet of the vacuum cleaner nozzle.

This problem has been recognized in the prior art, for example in U.S. Pat. No. 6,401,296 B1 to McKnight et al., disclosed is a removable suction nozzle to convert the suction inlet of a vacuum cleaner from a straight surface to either a concave or convex surface for vacuuming carpet with matching concave or convex surfaces, such as stair steps, reference FIG. 8. McKnight et al. also discloses the use of the nozzle to be used with a hand held hot water extractor having spray guide grooves and strakes to direct the spray toward the suction. However, McKnight et al. does not disclose a "U" shaped opening and primarily utilizes a single attachment head having a rotatable chamber or a double ended attachment head with both concave and convex surfaces. Similarly, in U.S. Pat. No. 6,038,732 also to McKnight et al., comprises a divisional patent of the aforementioned McKnight et al. patent being U.S. Pat. No. 6,401,296 B1 and thus having the same disclosure, teaches the same suction nozzle configurations.

Another approach in the prior art that is somewhat more specialized is in U.S. Pat. No. 6,029,310 to Besel that discloses a wand for vacuuming stairs with a nozzle bar for applying a liquid cleaning material within a vacuum slot; the wand vacuum slots are length adjustable to conform to a stair step run length and terminate just around the corner of the run forming a half "U" section. An elongated vacuum tube is utilized to allow the operator to stand erect while using the wand and not having to kneel down, however, it appears that the wand misses the lower and middle portion of the stair rise for cleaning and cannot clean around a toe portion of the step. An alternative approach is in U.S. Pat. No. 5,502,070 to Ragner et al. that discloses a multiple function vacuum cleaner nozzle having two straight pivotal cleaning arms that are adjustable in relation to each other. Each cleaning arm has a hollow cleaning channel with a row of bristles on each channel edge; the arms are movable through a total range of 180 degrees from being a straight line and to being parallel to each other. Thus, Ragner et al. could be used on stairs, however, would not be able to accommodate the run toe overhang for cleaning. In addition, Ragner et al. does not disclose anything pertaining to solution cleaning in conjunction with vacuuming. Further, in U.S. Pat. No. 5,377,375 to Holman et al. disclosed is a stair cleaning device having three cleaning heads that can be operated either horizontally or vertically in order to clean the run or the rise of the step respectively. Again, Holman et al. does not have the capability or teaches a way to accommodate the toe portion overhang of the step run.

What is needed, is a simple and inexpensive surface cleaning device that can effectively accommodate the "toe" portion of the step being between the rise and the run of the step, even when the "toe" is overhung in relation to the adjacent step rise. In addition, the surface cleaning device would include the capability to accommodate different outside radii or convex/concave surface profile configurations of the "toe" portion of the step with easy interchangeability for different surface or "toe" profiles, that could also include, for example different furniture arm profiles or other similar surface or fabric/upholstery/carpet profiles that need cleaning. Also, the surface cleaning device should have the option of incorporating solution/steam cleaning in combination with vacuum cleaning if desired by the user. Scrubbing bristles could also be included along the concave/convex profile of the surface cleaning device that approximately match in surface profile the convex/concave profile of the surface to be cleaned for more effective cleaning by raising the fabric nap or scrubbing the surface prior to the vacuum and/or steam cleaning.

SUMMARY OF INVENTION

Broadly, the present invention is a surface cleaning device adapted for use with a vacuum cleaner nozzle inlet to clean a selected surface profile. The surface cleaning device includes a housing with a surrounding sidewall positioned about a housing longitudinal axis to define a housing interior separated from an exterior environment. Also included is a divider disposed within the housing interior that is adjacent to the surrounding sidewall. The divider is oriented approximately perpendicular to the housing longitudinal axis such that the housing interior is separated into a first housing interior and a second housing interior. The housing surrounding sidewall terminating in a first opening communicating between the first housing interior and the exterior environment and a second opening communicating between the second housing interior and the exterior environment. The first opening is approximately matched in profile to the selected surface profile to be cleaned and the second opening is approximately matched in profile to another selected surface profile to be cleaned.

Further included is a divider aperture collar that is adjacent to the divider forming a fluid communication therethrough the divider between the first housing interior and the second housing interior. The divider aperture collar is positioned lengthwise to be substantially parallel to the housing longitudinal axis, with the divider aperture collar being sized and configured to be removably engagable to the vacuum cleaner nozzle inlet to create a substantially fluid tight communication selectively between either the first housing interior and the vacuum cleaner nozzle inlet or the second housing interior and the vacuum cleaner nozzle inlet.

These and other objects of the present invention will become more readily appreciated and understood from a consideration of the following detailed description of the exemplary embodiment(s) of the present invention when taken together with the accompanying drawings, in which;

REFERENCE NUMBER IN DRAWINGS

Figure 1:
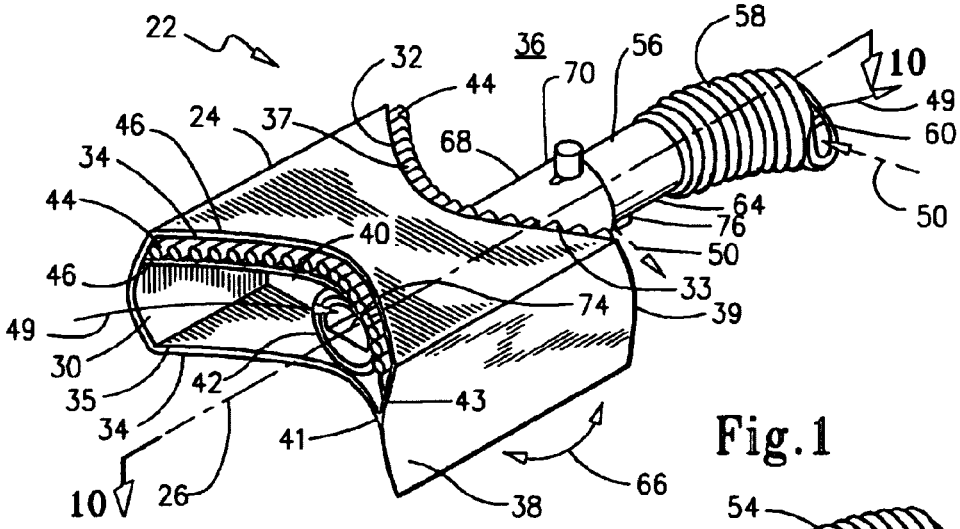
FIG. 1 shows a perspective view assembly of the surface cleaning device assembly embodiment for vacuum and solution cleaning.

20 Surface cleaning device assembly embodiment for vacuum cleaning
22 Surface cleaning device assembly embodiment for vacuum and solution cleaning
24 Housing
26 Housing longitudinal axis
28 First housing interior
30 Second housing interior
32 Housing surrounding sidewall terminal first opening
33 Terminal first opening continuously curved perimeter surface
34 Housing surrounding sidewall terminal second opening
35 Terminal second opening continuously curved perimeter surface
36 Exterior environment
37 Terminal first opening concave sections
38 Housing surrounding sidewall
39 Terminal first opening convex sections
40 Divider
41 Terminal second opening concave sections
42 Divider aperture collar
43 Terminal second opening convex sections
44 Housing bristles
46 Housing bristles retainer
48 Vacuum fluid flow with contaminants
49 Vacuum fluid flow with solution and contaminants
50 Cleaning solution fluid flow
52 Vacuum cleaner hose distal end
54 Vacuum cleaner hose
56 Vacuum and solution cleaner hose distal end
58 Vacuum and solution cleaner hose
60 Vacuum and solution cleaner hose barrier
62 Vacuum and solution cleaner hose distal end vacuum portion
64 Vacuum and solution cleaner hose distal end solution portion
66 Housing rotational arrows
68 Adapter between vacuum and solution cleaner hose distal end and housing
70 Adapter proximal end portion
72 Adapter distal end portion
74 Adapter vacuum channel
76 Solution spray nozzle
78 Stair rise portion
80 Stair run portion
82 Stair toe portion
84 Surface to be cleaned or selected surface profile
86 Stair corner portion

DETAILED DESCRIPTION

Figure 2:
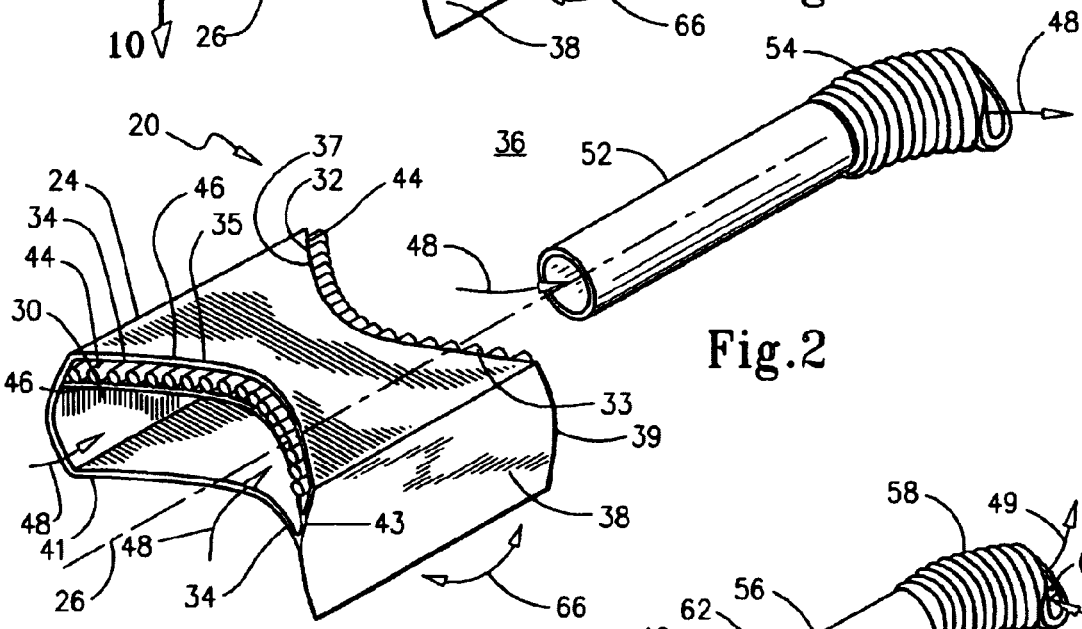
FIG. 2 shows an exploded perspective view of the surface cleaning device assembly embodiment for vacuum cleaning.
Figure 3:
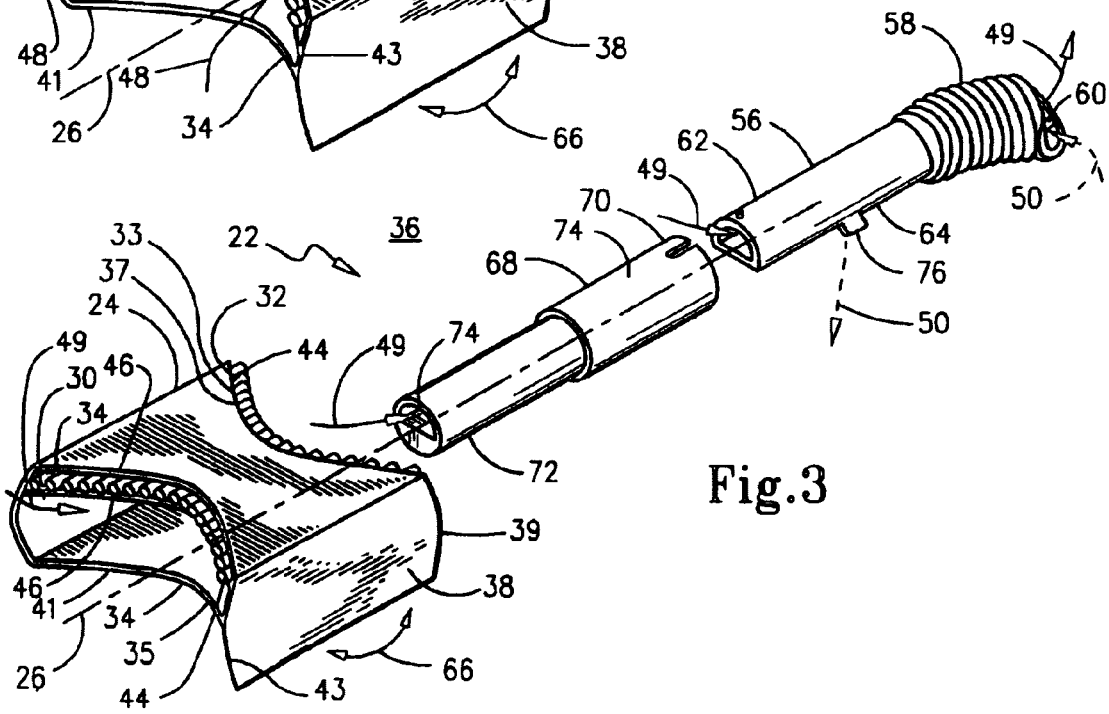
FIG. 3 shows an exploded perspective view of the surface cleaning device assembly embodiment for vacuum and solution cleaning.
Figure 4:
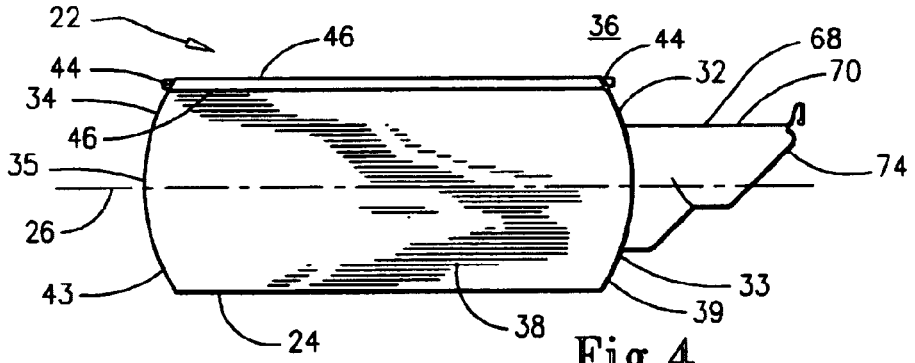
FIG. 4 shows a side elevation view of the surface cleaning device embodiment for vacuum and solution cleaning.
Figure 5:
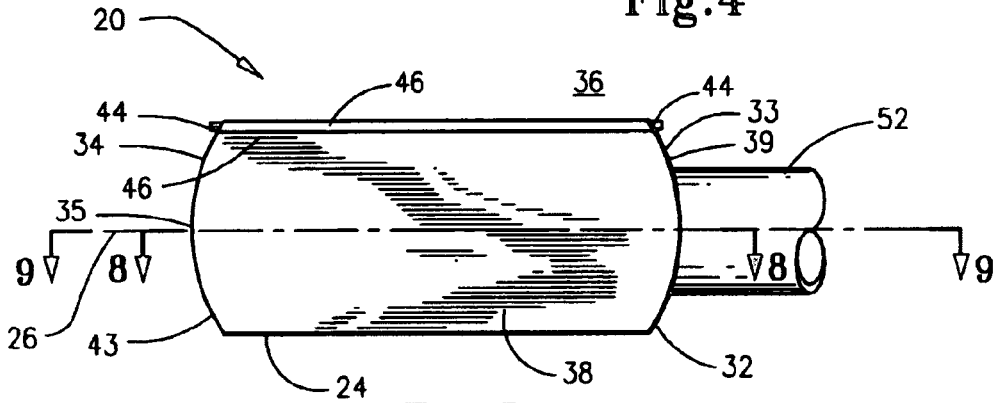
FIG. 5 shows a side elevation view of the surface cleaning device embodiment for vacuum cleaning.
Figure 6:
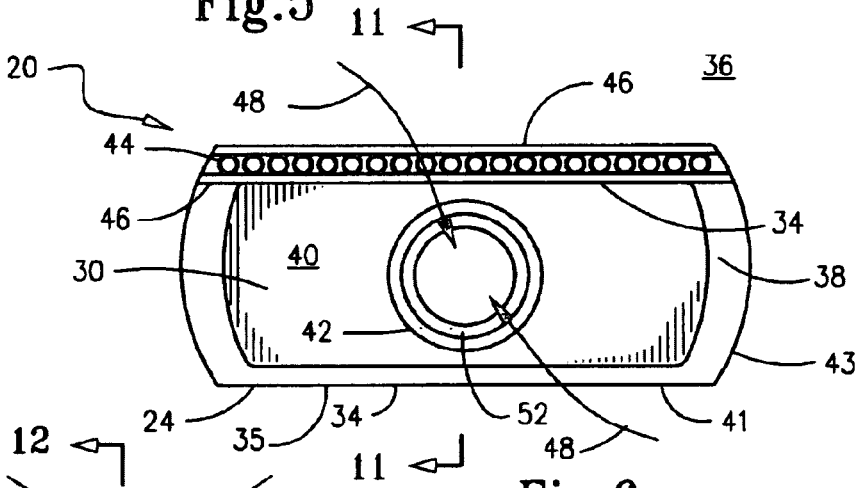
FIG. 6 shows an end view of the surface cleaning device embodiment for vacuum cleaning.
Figure 7:
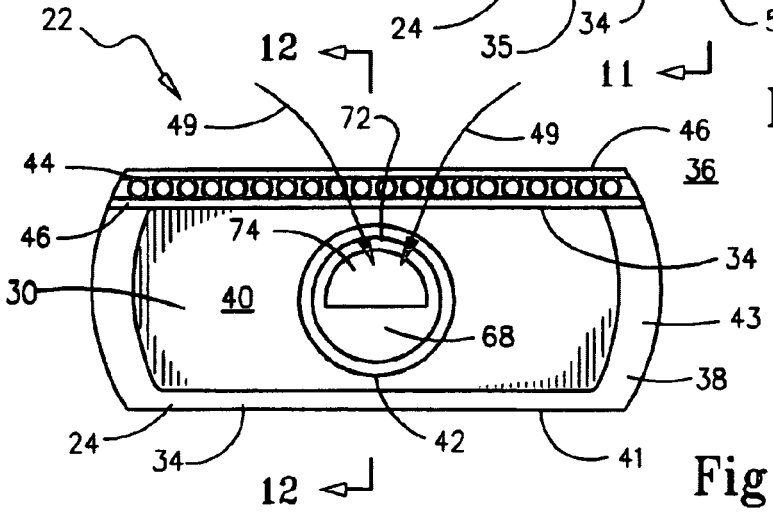
FIG. 7 shows an end view of the surface cleaning device embodiment for vacuum and solution cleaning.
Figure 8:
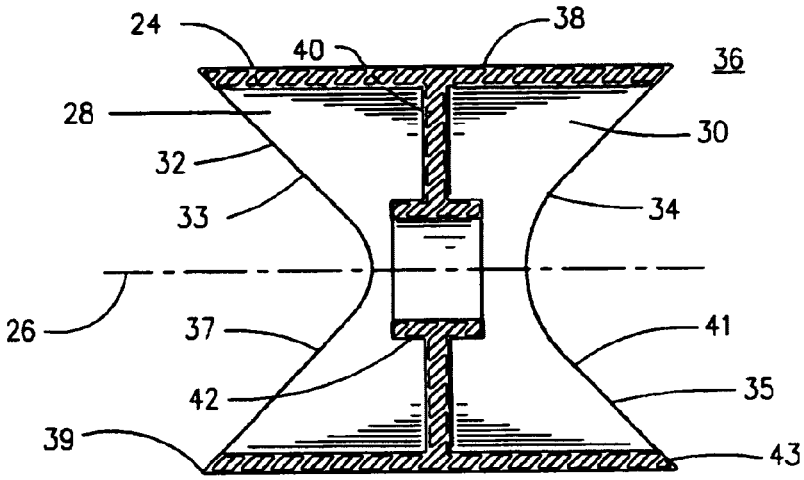
FIG. 8 shows crossectional view 8—8 from FIG. 5 for the housing not including the vacuum cleaner hose distal end.
Figure 9:
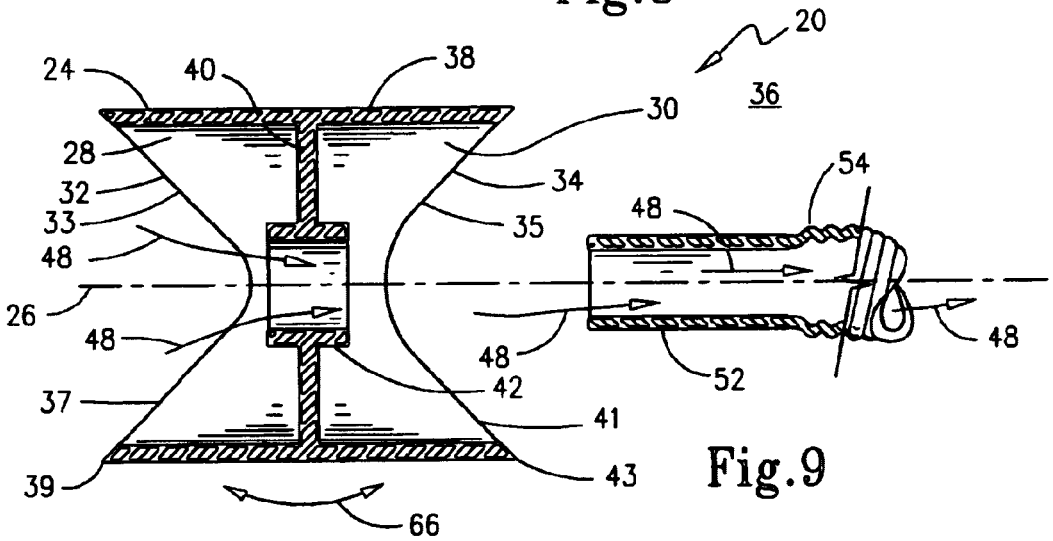
FIG. 9 shows crossectional view 9—9 from FIG. 5 for the housing including the vacuum cleaner hose distal end removed from the housing for clarity.
Figure 10:
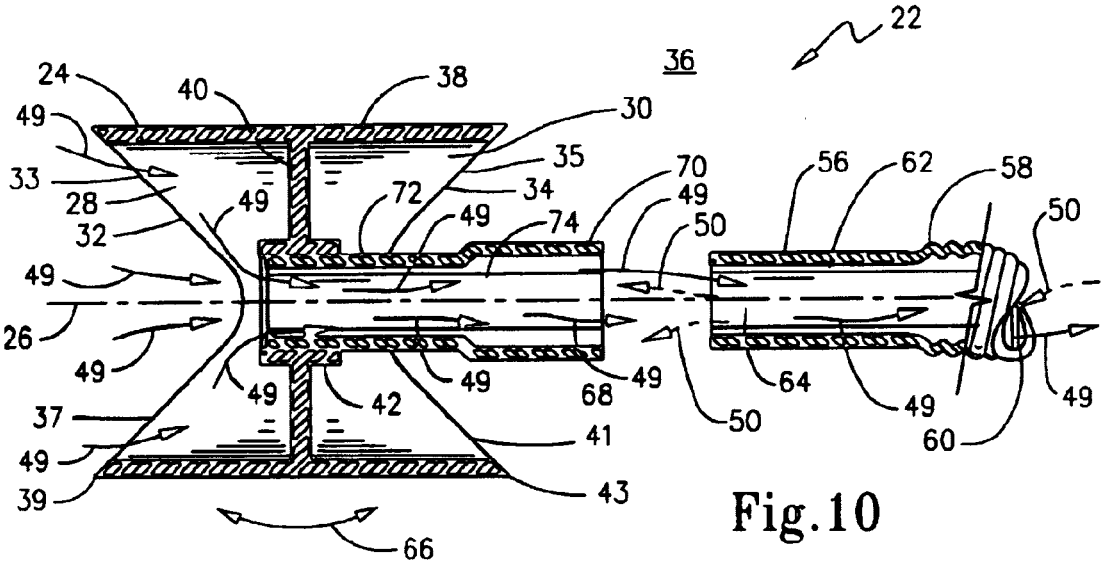
FIG. 10 shows crossectional view 10—10 from FIG. 1 for the housing including the adapter and the vacuum and solution cleaner hose distal end removed from the adapter for clarity.
Figure 11:
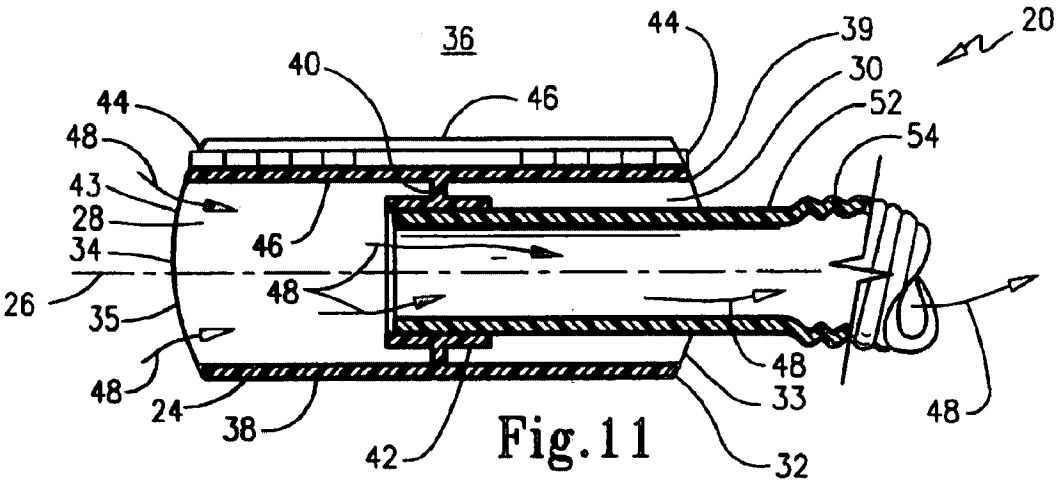
FIG. 11 shows crossectional view 11—11 from FIG. 6 for the housing including the vacuum cleaner hose distal end and hose.
Figure 12:
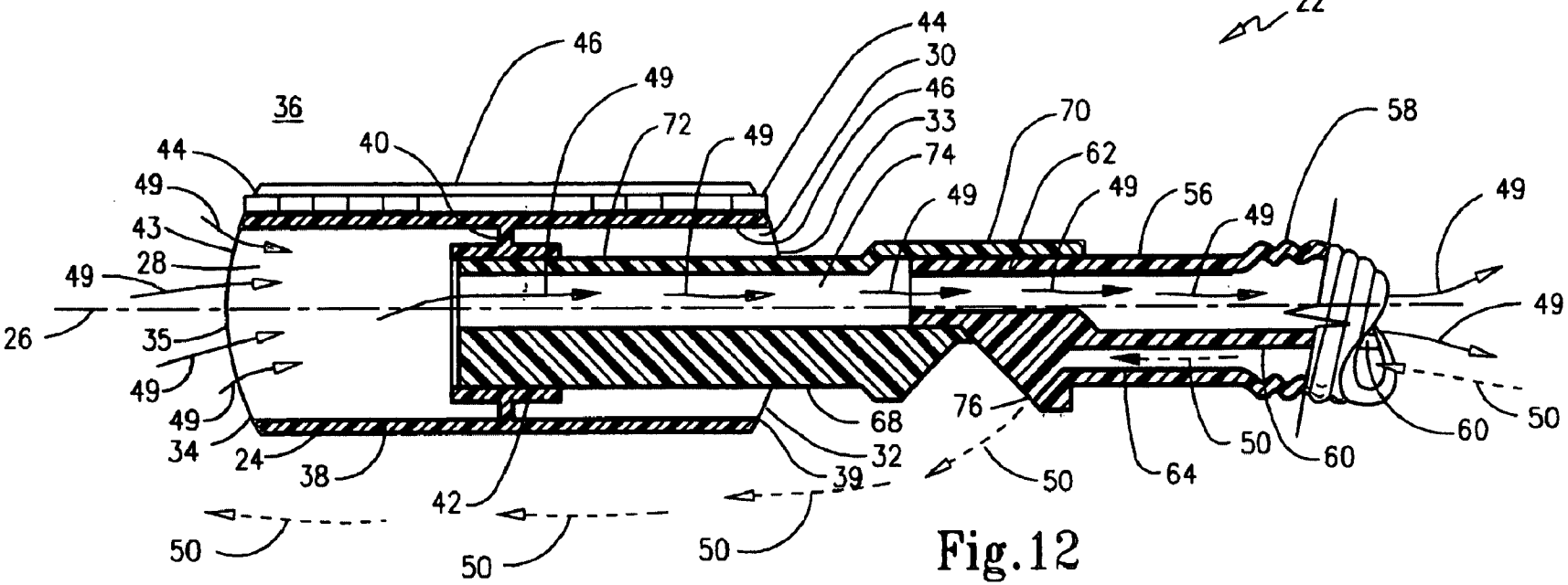
FIG. 12 shows crossectional view 12—12 from FIG. 7 for the housing including the adapter and the vacuum and solution cleaner hose distal end and hose.
Figure 13:
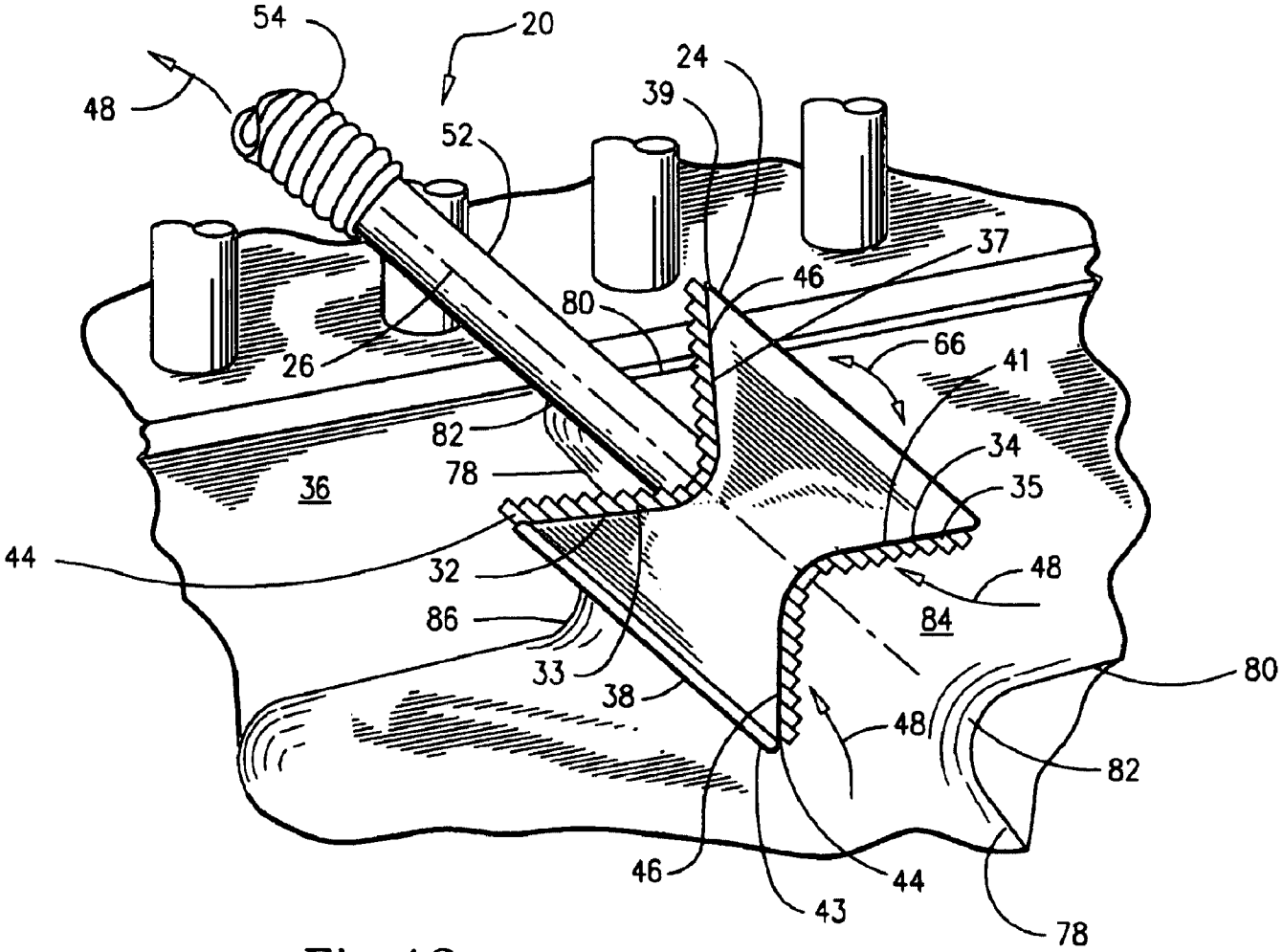
FIG. 13 shows a perspective use view of the surface cleaning device assembly embodiment for vacuum cleaning the surface of the toe portion of a step.

With initial reference to FIGS. 1–13, FIG. 1 shows a perspective view assembly of the surface cleaning device assembly 22 embodiment for vacuum and solution cleaning, FIG. 2 shows an exploded perspective view of the surface cleaning device assembly embodiment 20 for vacuum cleaning, and FIG. 3 shows an exploded perspective view of the surface cleaning device assembly 22 embodiment for vacuum and solution cleaning. FIG. 4 shows a side elevation view of the surface cleaning device 22 embodiment for vacuum and solution cleaning, FIG. 5 shows a side elevation view of the surface cleaning device 20 embodiment for vacuum cleaning, and FIG. 6 shows an end view of the surface cleaning device 20 embodiment for vacuum cleaning. FIG. 7 shows an end view of the surface cleaning device 22 embodiment for vacuum and solution cleaning, FIG. 8 shows crossectional view 8—8 from FIG. 5 for the housing 24 not including the vacuum cleaner hose distal end 52, and FIG. 9 shows crossectional view 9—9 from FIG. 5 for the housing 24 including the vacuum cleaner hose distal end 52 removed from the housing 24 for clarity. FIG. 10 shows crossectional view 10—10 from FIG. 1 for the housing 24 including the adapter 68 and the vacuum and solution cleaner hose distal end 64 removed from the adapter 68 for clarity, FIG. 11 shows crossectional view 11—11 from FIG. 6 for the housing 24 including the vacuum cleaner hose distal end 52 and hose 54, and FIG. 12 shows crossectional view 12—12 from FIG. 7 for the housing 24 including the adapter 68 and the vacuum and solution cleaner hose distal end 56 and hose 58. FIG. 13 shows a perspective use view of the surface cleaning device assembly 20 embodiment for vacuum cleaning the surface 84 of the toe portion 82 of a step in conjunction with a stair rise portion 78 and stair run portion 80.

The surface cleaning device 20 embodiment that is adapted for use with a vacuum cleaner nozzle inlet or distal end 52 to clean a selected surface 84 profile, includes a housing 24 with a surrounding sidewall 38 positioned about a housing longitudinal axis 26 to define a housing interior, being 28 and 30 separated from an exterior environment 36.

Also included for the surface cleaning device 20 embodiment is a divider 40 disposed within the housing 24 interior 28 and 30 and adjacent to the surrounding sidewall 38, the divider 40 is oriented approximately perpendicular to the housing longitudinal axis 26 such that the housing 24 interior and is separated into a first housing interior 28 and a second housing interior 30. The housing surrounding sidewall 38 terminates in a first opening 32 communicating between the first housing interior 28 and the exterior environment 36 and a second opening 34 communicating between the second housing interior 30 and the exterior environment 36. The first opening 32 is approximately matched in profile to the selected surface profile 84 to be cleaned and the second opening 34 is approximately matched in profile to another selected surface profile 84 to be cleaned. The selected surface profile 84 to be cleaned can be any profile possible, for example a convex profile 82 or a concave profile 86, only requiring that the first opening 32 or the second opening 34 be approximately matched in profile to the selected surface profile. For example, a first opening 32 being concave to clean a convex selected surface profile 84.

Further included in the surface cleaning device 20 is a divider aperture collar 42 that is adjacent to the divider 40 forming a fluid communication therethrough the divider 40 between the first housing interior 28 and the second housing interior 30. The divider aperture collar 42 is positioned lengthwise to be substantially parallel to the housing longitudinal axis 26. The divider aperture collar 42 is sized and configured to be removably engagable to the vacuum cleaner nozzle inlet or distal end 52 to create a substantially fluid tight communication 48 selectively between either the first housing interior 28 and the vacuum cleaner nozzle inlet or distal end 52, or the second housing interior 30 and the vacuum cleaner nozzle inlet or distal end 52. Note that this selectivity between the either the first housing interior 28 and the vacuum cleaner nozzle inlet or distal end 52, or the second housing interior 30 and the vacuum cleaner nozzle inlet or distal end 52 is accomplished by rotating 66 the housing 24 one hundred and eighty degrees or a half turn when the housing 24 is removed from the vacuum cleaner nozzle inlet or distal end 52 (see FIG. 9) and then subsequently removably engaging the vacuum cleaner nozzle inlet or distal end 52 into the divider aperture collar 42 (see FIG. 11).

Also, optionally the first opening 32 can have a plurality of bristles 44 disposed upon the first opening 32. The bristles 44 can be retained by a bristles retainer 46 by compression clamping the root of the bristle 44, or adhesives, and the like. Further, optionally the second opening 34 can have a plurality of bristles 44 disposed upon the second opening 34. The bristles 44 can be retained by a bristles retainer 46 by compression clamping the root of the bristle 44, or adhesives, and the like.

Going into further detail on the first opening 32, the first opening 32 can optionally have a continuously curved perimeter surface 33 defining the first opening 32 that includes oppositely disposed concave 37 sections and oppositely disposed convex 39 sections. Wherein the concave 37 and convex 39 sections are continuous, and the concave 37 or convex 39 sections are approximately matched in profile to the selected surfaces 84 to be cleaned that have a respective convex 82 or concave 86 profile. Also, optionally the first opening 32 that has a continuously curved perimeter surface 33 can have a plurality of bristles 44 disposed upon the first opening 32 that has a continuously curved perimeter surface 33. The bristles 44 can be retained by a bristles retainer 46 by compression clamping the root of the bristle 44, or adhesives, and the like.

Further, for the detail on the second opening 34, the second opening 34 can optionally have a continuously curved perimeter surface 35 defining the second opening 34 that includes oppositely disposed concave 41 sections and oppositely disposed convex 43 sections. Wherein the concave 41 and convex 43 sections are continuous, and the concave 41 or convex 43 sections are approximately matched in profile to the selected surfaces 84 to be cleaned that have a respective convex 82 or concave 86 profile. Also, optionally the second opening 34 that has a continuously curved perimeter surface 35 can have a plurality of bristles 44 disposed upon the second opening 34 that has a continuously curved perimeter surface 35. The bristles 44 can be retained by a bristles retainer 46 by compression clamping the root of the bristle 44, or adhesives, and the like.

With respect to the concave 37 and convex 39 sections and the concave 41 and convex 43 sections, four different selected surface profiles 84 can be cleaned with the use of a single surface cleaning device 20. With the aforementioned concave 37 and convex 39 sections and the concave 41 and convex 43 sections being able to approximately match two different convex 82 profile surfaces 84 to be cleaned and two different concave 86 profile surfaces 84 to be cleaned, with the use of a single surface cleaning device 20.

The surface cleaning device 20, housing 24, divider 40, and divider aperture collar 42 are preferably constructed of materials selected from the group consisting essentially of polyethylene, polypropylene, and polyurethane materials or other similar type materials.

The surface cleaning device 22 embodiment is adapted for use with a vacuum and solution cleaner nozzle inlet or distal end 56 to clean a selected surface 84 profile, includes a housing 24 with a surrounding sidewall 38 positioned about a housing longitudinal axis 26 to define a housing interior, being 28 and 30 separated from an exterior environment 36.

Also included for the surface cleaning device 22 embodiment is a divider 40 disposed within the housing 24 interior 28 and 30 and adjacent to the surrounding sidewall 38, the divider 40 is oriented approximately perpendicular to the housing longitudinal axis 26 such that the housing interior 28 and 30 is separated into a first housing interior 28 and a second housing interior 30. The housing surrounding sidewall 38 terminating in a first opening 32 communicating between the first housing interior 28 and the exterior environment 36 and a second opening 34 communicating between the second housing interior 30 and the exterior environment 36. The first opening 32 is approximately matched in profile to the selected surface profile 84 to be cleaned and the second opening 34 approximately matched in profile to another selected surface profile 84 to be cleaned. The selected surface profile 84 to be cleaned can be any profile possible, for example a convex profile 82 or a concave profile 86, only requiring that the first opening 32 or the second opening 34 be approximately matched in profile to the selected surface profile. For example, a first opening 32 being concave to clean a convex selected surface profile 84.

Further included in the surface cleaning device 22 is a divider aperture collar 42 that is adjacent to the divider 40 forming a fluid communication therethrough the divider 40 between the first housing interior 28 and the second housing interior 30. The divider aperture collar 42 is positioned lengthwise to be substantially parallel to the housing longitudinal axis 26.

Further included in the surface cleaning device 22 is an adapter 68 that includes a proximal end portion 70 and a distal end portion 72. The adapter proximal end portion 70 is sized and configured to be removably engagable to the vacuum and solution cleaner nozzle inlet or distal end 56 with the adapter distal end portion 72 being sized and configured to be removably engagable to the divider aperture collar 42. The adapter 68 also includes a vacuum channel 74 that forms a substantially fluid tight communication 48 selectively between either the vacuum cleaner nozzle inlet distal end portion 62 and the first housing interior 28 or the vacuum cleaner nozzle inlet distal end portion 62 and the second housing interior 30. The vacuum and solution hose 58 also includes a barrier 60 that separates the vacuum fluid flow 49 and the solution fluid flow 50 in the hose 58.

Note that this selectivity between the either the first housing interior 28 and the adapter distal end 72 or the second housing interior 30 and the adapter distal end 72 is accomplished by rotating 66 the housing 24 one hundred and eighty degrees or a half turn when the housing 24 is removed from the adapter distal end 72 (see FIG. 3) and then subsequently removably engage the adapter distal end 72 into the divider aperture collar 42 (see FIG. 12).

Also, optionally the first opening 32 can have a plurality of bristles 44 disposed upon the first opening 32. The bristles 44 can be retained by a bristles retainer 46 by compression clamping the root of the bristle 44, or adhesives, and the like. Further, optionally the second opening 34 can have a plurality of bristles 44 disposed upon the second opening 34. The bristles 44 can be retained by a bristles retainer 46 by compression clamping the root of the bristle 44, or adhesives, and the like.

Going into further detail on the first opening 32, the first opening 32 can optionally have a continuously curved perimeter surface 33 defining the first opening 32 that includes oppositely disposed concave 37 sections and oppositely disposed convex 39 sections. Wherein the concave 37 and convex 39 sections are continuous, and the concave 37 or convex 39 sections are approximately matched in profile to the selected surfaces 84 to be cleaned that have a respective convex 82 or concave 86 profile. Also, optionally the first opening 32 that has a continuously curved perimeter surface 33 can have a plurality of bristles 44 disposed upon the first opening 32 that has a continuously curved perimeter surface 33. The bristles 44 can be retained by a bristles retainer 46 by compression clamping the root of the bristle 44, or adhesives, and the like.

Further, for the detail on the second opening 34, the second opening 34 can optionally have a continuously curved perimeter surface 35 defining the second opening 34 that includes oppositely disposed concave 41 sections and oppositely disposed convex 43 sections. Wherein the concave 41 and convex 43 sections are continuous, and the concave 41 or convex 43 sections are approximately matched in profile to the selected surfaces 84 to be cleaned that have a respective convex 82 or concave 86 profile. Also, optionally the second opening 34 that has a continuously curved perimeter surface 35 can have a plurality of bristles 44 disposed upon the second opening 34 that has a continuously curved perimeter surface 35. The bristles 44 can be retained by a bristles retainer 46 by compression clamping the root of the bristle 44, or adhesives, and the like.

With respect the concave 37 and convex 39 sections and the concave 41 and convex 43 sections, four different selected surface profiles 84 can be cleaned with the use of a single surface cleaning device 22. With the aforementioned concave 37 and convex 39 sections and the concave 41 and convex 43 sections being able to approximately match two different convex 82 profile surfaces 84 to be cleaned and two different concave 86 profile surfaces 84 to be cleaned, with the use of a single surface cleaning device 20.

The surface cleaning device 22, housing 24, divider 40, divider aperture collar 42, and adapter 68 are preferably constructed of materials selected from the group consisting essentially of polyethylene, polypropylene, and polyurethane materials or other similar type materials.

CONCLUSION

Accordingly, the present invention of a surface cleaning device assembly 20 and 22 has been described with some degree of particularity directed to the embodiment(s) of the present invention. It should be appreciated, though, that the present invention is defined by the following claims construed in light of the prior art so modifications or changes may be made to the exemplary embodiment(s) of the present invention without departing from the inventive concepts contained therein.

The invention claimed is:

1. A surface cleaning device adapted for use with a vacuum cleaner nozzle inlet to clean a selected surface profile, comprising:

(a) a housing including a surrounding sidewall positioned about a housing longitudinal axis to define a housing interior separated from an exterior environment;

(b) a divider disposed within said housing interior and adjacent to said surrounding sidewall, said divider is oriented approximately perpendicular to the housing longitudinal axis such that said housing interior is separated into a first housing interior and a second housing interior, said housing surrounding sidewall terminating in a first opening communicating between said first housing interior and the exterior environment and a second opening communicating between said second housing interior and the exterior environment, said first opening approximately matched in profile to the selected surface profile to be cleaned and said second opening approximately matched in profile to another selected surface profile to be cleaned; and (c) a divider aperture collar that is adjacent to said divider forming a fluid communication therethrough said divider between said first housing interior and said second housing interior, said divider aperture collar is positioned lengthwise to be substantially parallel to the housing longitudinal axis, said divider aperture collar is sized and configured to be removably engagable to the vacuum cleaner nozzle inlet to create a substantially fluid tight communication selectively between either said first housing interior and the vacuum cleaner nozzle inlet or said second housing interior and the vacuum cleaner nozzle inlet.

2. The surface cleaning device according to claim 1 wherein said housing surrounding sidewall that terminates into said first opening has a continuously curved perimeter surface defining said first opening that includes oppositely disposed concave sections and oppositely disposed convex sections, wherein said concave and convex sections are continuous, said concave or convex sections are approximately matched in profile to the selected surfaces to be cleaned that have a respective convex or concave profile.

3. The surface cleaning device according to claim 2 wherein said first opening that has a continuously curved perimeter surface has a plurality of bristles disposed upon said first opening that has a continuously curved perimeter surface.

4. The surface cleaning device according to claim 1 wherein said housing surrounding sidewall that terminates into said second opening has a continuously curved perimeter surface defining said second opening that includes oppositely disposed concave sections and oppositely disposed convex sections, wherein said concave and convex sections are continuous, said concave or convex sections are approximately matched in profile to the selected surfaces to be cleaned that have a respective convex or concave profile.

5. The surface cleaning device according to claim 4 wherein said second opening that has a continuously curved perimeter surface has a plurality of bristles disposed upon said second opening that has a continuously curved perimeter surface.

6. The surface cleaning device according to claim 1 wherein said housing surrounding sidewall that terminates into said first opening has a plurality of bristles disposed upon said first opening.

7. The surface cleaning device according to claim 1 wherein said housing surrounding sidewall that terminates into said second opening has a plurality of bristles disposed upon said second opening.

8. The surface cleaning device according to claim 1 wherein said housing, divider, and divider aperture collar are constructed of materials selected from the group consisting essentially of polyethylene, polypropylene, and polyurethane materials.

9. A surface cleaning device adapted for use with a vacuum and solution cleaner nozzle inlet to clean a selected surface profile, comprising:

(a) a housing including a surrounding sidewall positioned about a housing longitudinal axis to define a housing interior separated from an exterior environment;

(b) a divider disposed within said housing interior and adjacent to said surrounding sidewall, said divider is oriented approximately perpendicular to the housing longitudinal axis such that said housing interior is separated into a first housing interior and a second housing interior, said housing surrounding sidewall terminating in a first opening communicating between said first housing interior and the exterior environment and a second opening communicating between said second housing interior and the exterior environment, said first opening approximately matched in profile to the selected surface profile to be cleaned and said second opening approximately matched in profile to another selected surface profile to be cleaned;

(c) a divider aperture collar that is adjacent to said divider forming a fluid communication therethrough said divider between said first housing interior and said second housing interior, said divider aperture collar is positioned lengthwise to be substantially parallel to the housing longitudinal axis; and (d) an adapter that includes a proximal end portion and a distal end portion, said adapter proximal end portion is sized and configured to be removably engagable to the vacuum and solution cleaner nozzle inlet and said adapter distal end portion is sized and configured to be removably engagable to said divider aperture collar, said adapter also includes a vacuum channel that forms a substantially fluid tight communication selectively between either the vacuum cleaner nozzle inlet and said first housing interior or the vacuum cleaner nozzle inlet and said second housing interior.

10. The surface cleaning device according to claim 9 wherein said housing surrounding sidewall that terminates into said first opening has a continuously curved perimeter surface defining said first opening that includes oppositely disposed concave sections and oppositely disposed convex sections, wherein said concave and convex sections are continuous, said concave or convex sections are approximately matched in profile to the selected surfaces to be cleaned that have a respective convex or concave profile.

11. The surface cleaning device according to claim 10 wherein said first opening that has a continuously curved perimeter surface has a plurality of bristles disposed upon said first opening that has a continuously curved perimeter surface.

12. The surface cleaning device according to claim 9 wherein said housing surrounding sidewall that terminates into said second opening has a continuously curved perimeter surface defining said second opening that includes oppositely disposed concave sections and oppositely disposed convex sections, wherein said concave and convex sections are continuous, said concave or convex sections are approximately matched in profile to the selected surfaces to be cleaned that have a respective convex or concave profile.

13. The surface cleaning device according to claim 12 wherein said second opening that has a continuously curved perimeter surface has a plurality of bristles disposed upon said second opening that has a continuously curved perimeter surface.

14. The surface cleaning device according to claim 9 wherein said housing surrounding sidewall that terminates into said first opening has a plurality of bristles disposed upon said first opening.

15. The surface cleaning device according to claim 9 wherein said housing surrounding sidewall that terminates into said second opening has a plurality of bristles disposed upon said second opening.

16. The surface cleaning device according to claim 9 wherein said housing, divider, divider aperture collar, and adapter are constructed of materials selected from the group consisting essentially of polyethylene, polypropylene, and polyurethane materials.

* * * * *